US011651912B1

(12) United States Patent
Pan et al.

(10) Patent No.: US 11,651,912 B1
(45) Date of Patent: May 16, 2023

(54) CONTROL DEVICE

(71) Applicant: PRIMAX ELECTRONICS LTD., Taipei (TW)

(72) Inventors: Yung-Tai Pan, Taipei (TW); Jui-Jen Cheng, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 0 days.

(21) Appl. No.: 17/813,333

(22) Filed: Jul. 19, 2022

Related U.S. Application Data

(60) Provisional application No. 63/318,415, filed on Mar. 10, 2022.

(51) Int. Cl.
*H01H 13/14* (2006.01)
*H01H 13/70* (2006.01)
*H01H 13/83* (2006.01)

(52) U.S. Cl.
CPC ..... *H01H 13/7006* (2013.01); *H01H 13/83* (2013.01)

(58) Field of Classification Search
CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20
See application file for complete search history.

(56) References Cited

U.S. PATENT DOCUMENTS 5,438,177 A * 8/1995 Fagan ..... H01H 13/702 200/520
5,743,384 A * 4/1998 Clark ..... H01H 13/705 200/344

* cited by examiner

*Primary Examiner* — Ahmed M Saeed
(74) *Attorney, Agent, or Firm* — WPAT, P.C

(57) ABSTRACT

A control device includes a display panel and a key structure. The key structure is located over the display panel. The key structure includes a circuit board, a keycap, an elastic element and a conducting element. The circuit board includes a circuit structure. The circuit structure includes a first circuit pattern and a second circuit pattern. The first circuit pattern and the second circuit pattern are separated from each other by a gap. The conducting element is disposed on a support part of the elastic element. When the keycap is pressed down, the keycap is moved downwardly to push the support part. After the support part is moved downwardly for a specified travel distance, the conducting element is contacted with the first circuit pattern and the second circuit pattern. Consequently, the first circuit pattern and the second circuit pattern are electrically connected with each other.

10 Claims, 13 Drawing Sheets

CONTROL DEVICE

CROSS-REFERENCE TO RELATED APPLICATION

This application claims priority to U.S. Provisional Patent Application No. 63/318,415 filed Mar. 10, 2022, the contents of which are incorporated herein by reference.

FIELD OF THE INVENTION

The present invention relates to a control device, and more particularly to a control device with a display panel and at least one light-transmissible key structure.

BACKGROUND OF THE INVENTION

A control device is widely used in a live streaming machine, a live production switcher, an ordering machine or a drawing device. The control device comprises a display panel and plural light-transmissible key structures. Due to the cooperation of the display panel and the light-transmissible key structures, the control device has the visualized buttons for facilitating the user to select desired items and perform associated operations in an intuitive manner.

It is an important issue for the manufacturer to install a suitable key structure in the control device.

SUMMARY OF THE INVENTION

In order to overcome the drawbacks of the conventional technologies, the present invention provides a control device. The key structure of the control device is designed according to a pressure-sensitive technology.

In accordance with an aspect of the present invention, a control device is provided. The control device includes a display panel and a key structure. The key structure is located over the display panel. The key structure includes a circuit board, a keycap, an elastic element and a conducting element. The circuit board includes a first top surface, a circuit structure and a first opening. The circuit structure is installed on the first top surface and arranged around the first opening. The circuit structure includes a first circuit pattern and a second circuit pattern. The first circuit pattern and the second circuit pattern are separated from each other by a gap. The keycap is light-transmissible. The elastic element includes a support part, a lateral wall, a lower part and a second opening. The support part includes a second top surface and a bottom surface. The second top surface of the support part is upwardly connected with the keycap. The lateral wall is arranged between the support part and the lower part. The support part and the lateral wall are arranged around the second opening. The lower part is contacted with the circuit board. The conducting element is disposed on the bottom surface of the support part. When the keycap is pressed down, the keycap is moved downwardly to push the support part. After the support part is moved downwardly for a specified travel distance, the conducting element is contacted with the first circuit pattern and the second circuit pattern. Consequently, the first circuit pattern and the second circuit pattern are electrically connected with each other.

In an embodiment, the display panel emits a light beam, and the light beam is upwardly transmitted through the first opening, the second opening and the keycap.

In an embodiment, the conducting element is a metal sheet, a conductive rubber sheet, a carbon film, a conductive glue or a conductive foam.

In an embodiment, the conducting element is formed on the bottom surface of the support part by a carbon printing process, a spraying process, a coating process or an injection process.

In an embodiment, each of the first circuit pattern and the second circuit pattern has an L-shaped profile, an annular profile or a concave-convex staggered profile.

In accordance with another aspect of the present invention, a control device is provided. The control device includes a display panel and a key structure. The key structure is located over the display panel. The key structure includes a circuit board, a keycap and an elastic element. The circuit board includes a first top surface, a circuit structure and a first opening. The circuit structure is installed on the first top surface and arranged around the first opening. The circuit structure includes a first circuit pattern and a second circuit pattern. The first circuit pattern and the second circuit pattern are separated from each other by a gap. The keycap is light-transmissible. The elastic element includes a support part, a lateral wall, a lower part and a second opening. The support part includes a second top surface and a bottom surface. The second top surface of the support part is upwardly connected with the keycap. The lateral wall is arranged between the support part and the lower part. The support part and the lateral wall are arranged around the second opening. The lower part is contacted with the circuit board. The support part is electrically conductive. When the keycap is pressed down, the keycap is moved downwardly to push the support part. After the support part is moved downwardly for a specified travel distance, the bottom surface of the support part is contacted with the first circuit pattern and the second circuit pattern. Consequently, the first circuit pattern and the second circuit pattern are electrically connected with each other.

In an embodiment, the display panel emits a light beam, and the light beam is upwardly transmitted through the first opening, the second opening and the keycap.

In an embodiment, the support part is made of a conductive material.

In an embodiment, the support part is doped with a conductive material.

In an embodiment, each of the first circuit pattern and the second circuit pattern has an L-shaped profile, an annular profile or a concave-convex staggered profile.

In accordance with another aspect of the present invention, a control device is provided. The control device includes a display panel and a key structure. The key structure is located over the display panel. The key structure includes a keycap, an elastic element, a conducting element and a circuit board. The keycap is made of a light-transmissible material. The keycap includes a press surface, a wall part and a pedestal. The pedestal is horizontally and externally protruded from the wall part. The pedestal includes a top surface. The elastic element includes a support part, a lateral wall, a lower part and an opening. The support part is connected with the keycap. The lateral wall is arranged between the support part and the lower part. The support part and the lateral wall are arranged around the opening of the elastic element. The conducting element is disposed on the top surface of the pedestal or the support part. The circuit board is located over the elastic element. The circuit board includes a top surface, a circuit structure, an opening and a bottom surface. The circuit structure is installed on the bottom surface of the circuit board and arranged around the opening of the circuit board. The circuit structure includes a first circuit pattern and a second circuit pattern. The first circuit pattern and the second circuit pattern are separated from each other by a gap. When the keycap is not pressed down, the conducting element is contacted with the first circuit pattern and the second circuit pattern. Consequently, the first circuit pattern and the second circuit pattern are electrically connected with each other. When the keycap is pressed down, the conducting element is detached from the first circuit pattern and the second circuit pattern. Consequently, the first circuit pattern and the second circuit pattern are not electrically connected with each other.

In an embodiment, the display panel emits a light beam, and the light beam is upwardly transmitted through the opening of the elastic element, the opening of the circuit board and the keycap.

In an embodiment, the conducting element is a metal sheet, a conductive rubber sheet, a carbon film, a conductive glue or a conductive foam.

In an embodiment, the conducting element is formed on the pedestal or the support part by a carbon printing process, a spraying process, a coating process or an injection process.

In an embodiment, each of the first circuit pattern and the second circuit pattern has an L-shaped profile, an annular profile or a concave-convex staggered profile.

In accordance with another aspect of the present invention, a control device is provided. The control device includes a display panel and a key structure. The key structure is located over the display panel. The key structure includes a keycap, an elastic element and a circuit board. The keycap is made of a light-transmissible material. The keycap includes a press surface, a wall part and a pedestal. The pedestal is horizontally and externally protruded from the wall part. The pedestal includes a top surface. The elastic element includes a support part, a lateral wall, a lower part and an opening. The support part is connected with the keycap. The lateral wall is arranged between the support part and the lower part. The support part and the lateral wall are arranged around the opening of the elastic element. The support part is electrically conductive. The circuit board is located over the elastic element. The circuit board includes a top surface, a circuit structure, an opening and a bottom surface. The circuit structure is installed on the bottom surface of the circuit board and arranged around the opening of the circuit board. The circuit structure includes a first circuit pattern and a second circuit pattern. The first circuit pattern and the second circuit pattern are separated from each other by a gap. When the keycap is not pressed down, the support part is contacted with the first circuit pattern and the second circuit pattern. Consequently, the first circuit pattern and the second circuit pattern are electrically connected with each other. When the keycap is pressed down, the support part is detached from the first circuit pattern and the second circuit pattern. Consequently, the first circuit pattern and the second circuit pattern are not electrically connected with each other.

In an embodiment, the display panel emits a light beam, and the light beam is upwardly transmitted through the opening of the elastic element, the opening of the circuit board and the keycap.

In an embodiment, the support part is made of a conductive material.

In an embodiment, the support part is doped with a conductive material.

In an embodiment, each of the first circuit pattern and the second circuit pattern has an L-shaped profile, an annular profile or a concave-convex staggered profile.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. In the following embodiments and drawings, the elements irrelevant to the concepts of the present invention are omitted and not shown.

A first embodiment of the present invention provides a key structure and a control device using the key structure. The control device is applied to a live streaming machine, a live production switcher, an ordering machine or a drawing device.

Figure 1:
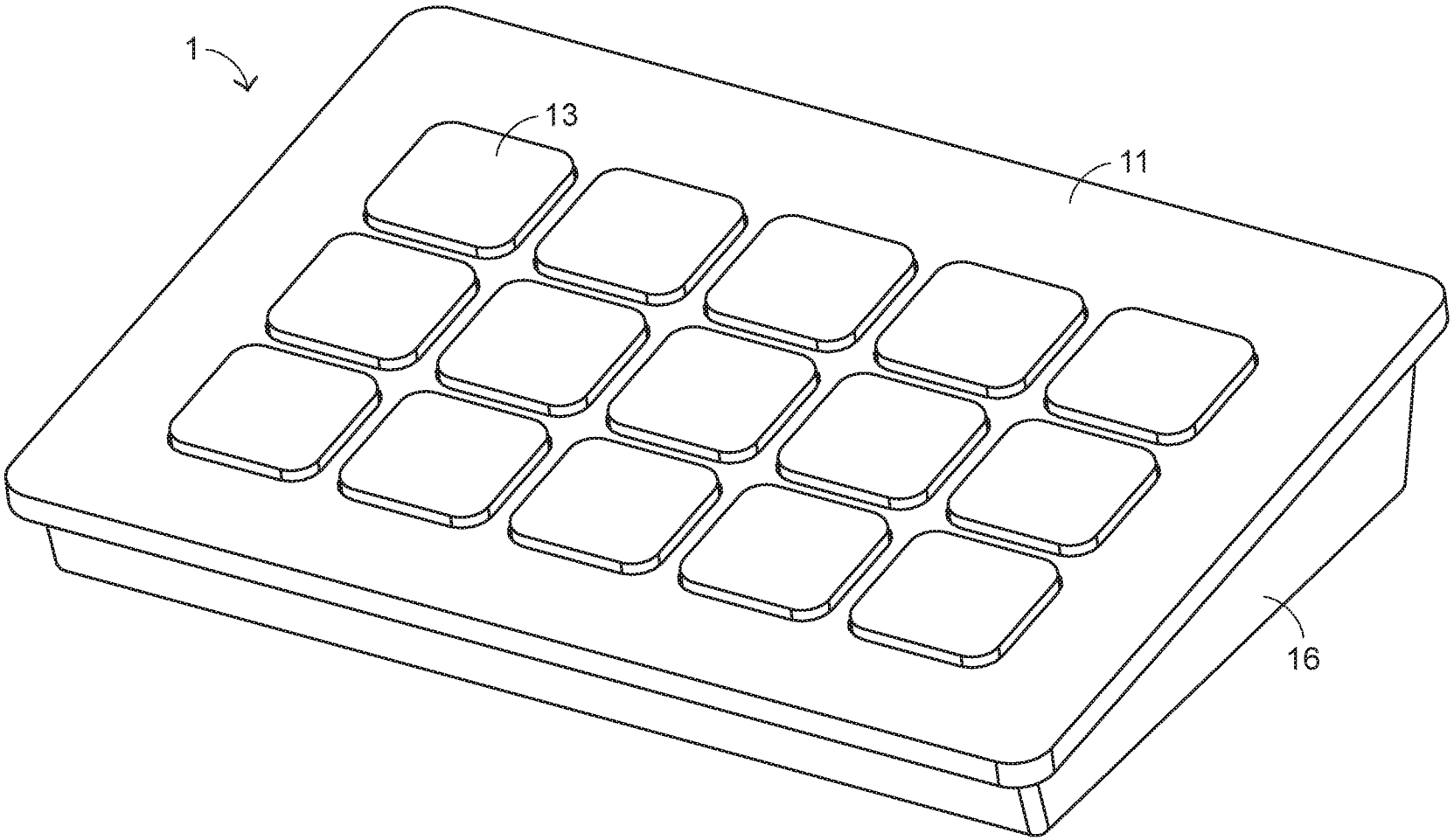
FIG. 1 is a schematic perspective view illustrating a control device according to a first embodiment of the present invention.
Figure 2:
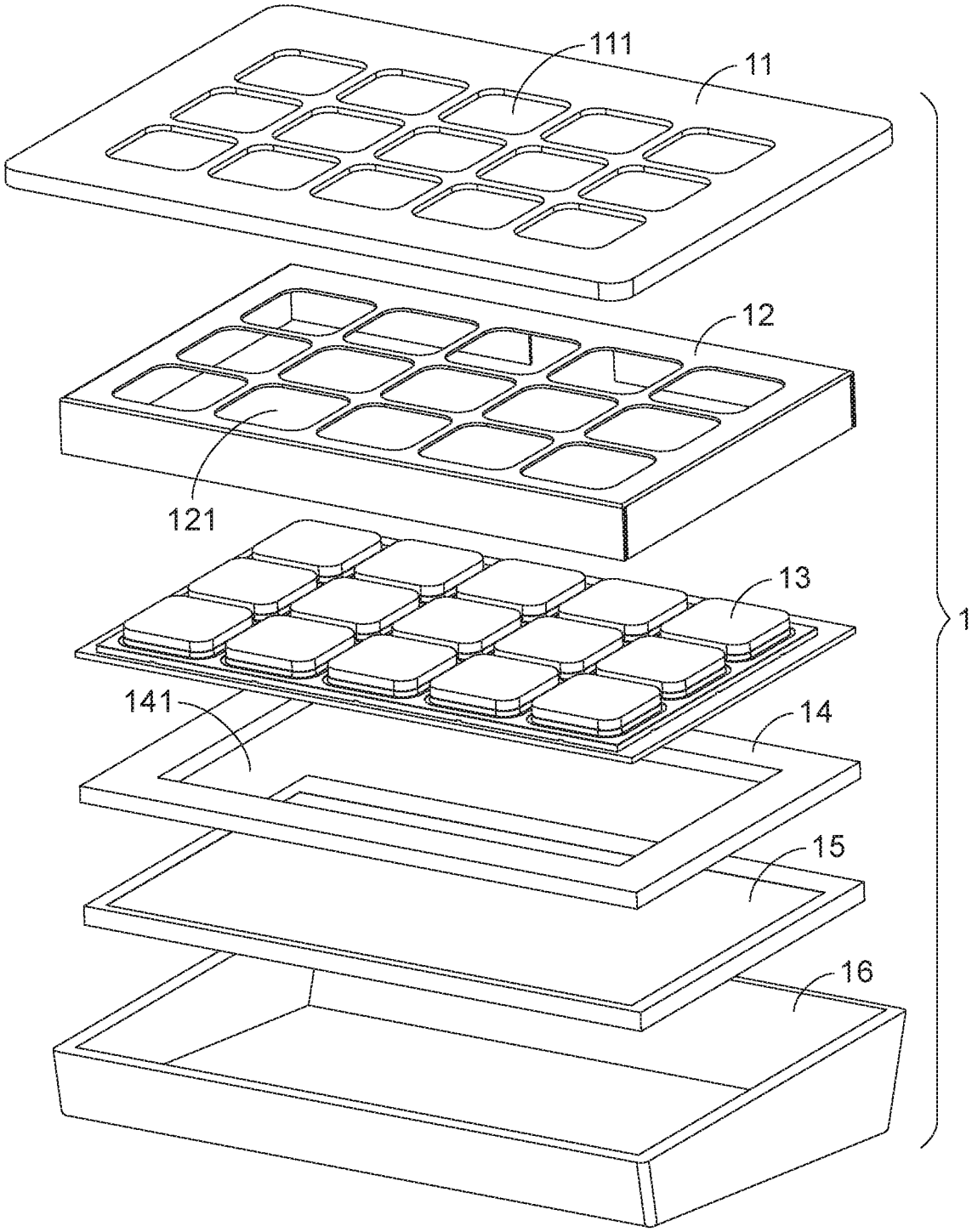
FIG. 2 is a schematic exploded view illustrating the control device as shown in FIG. 1.
Figure 3:
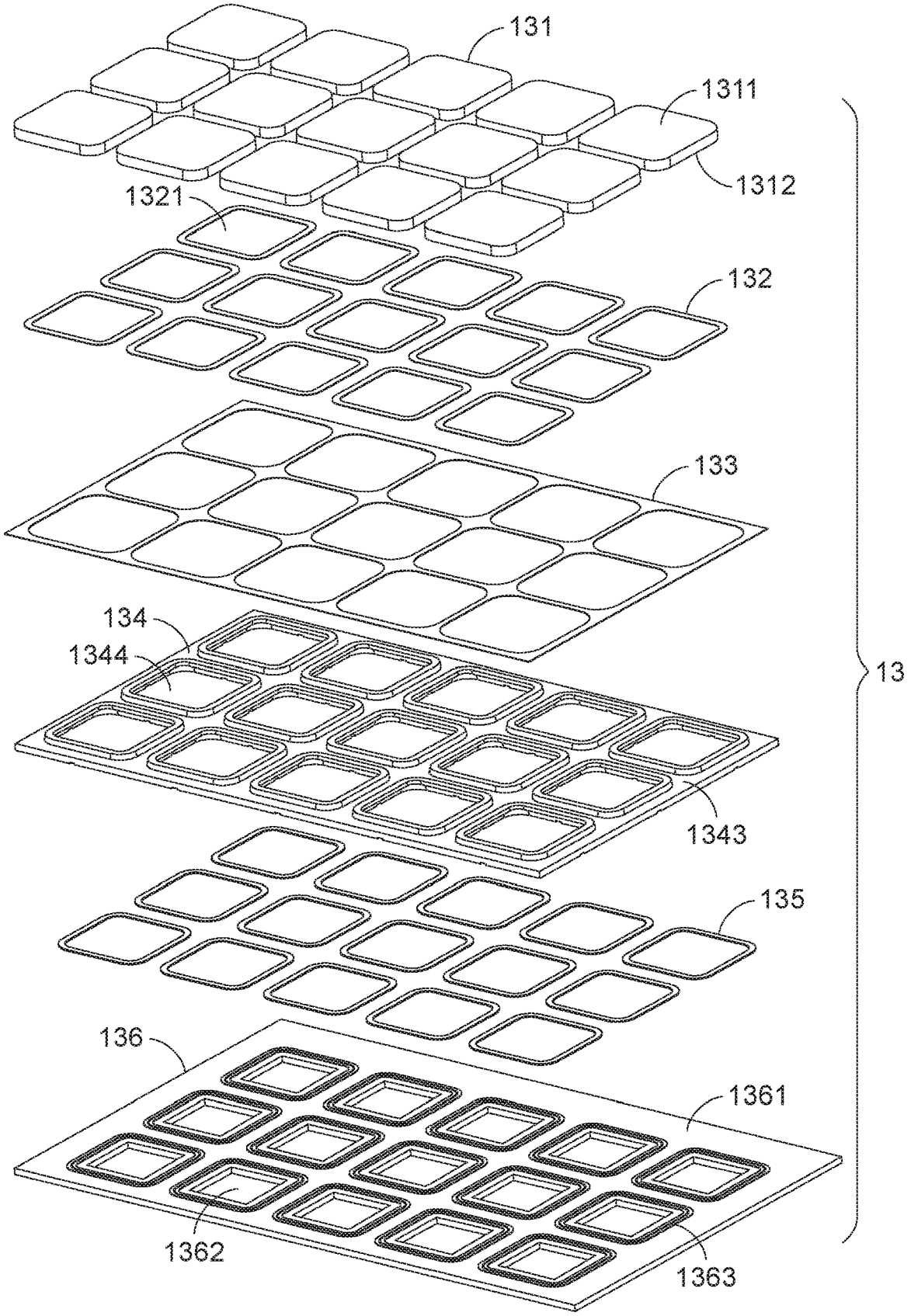
FIG. 3 is a schematic perspective view illustrating plural key structures of the control device as shown in FIG. 2.
Figure 4A:
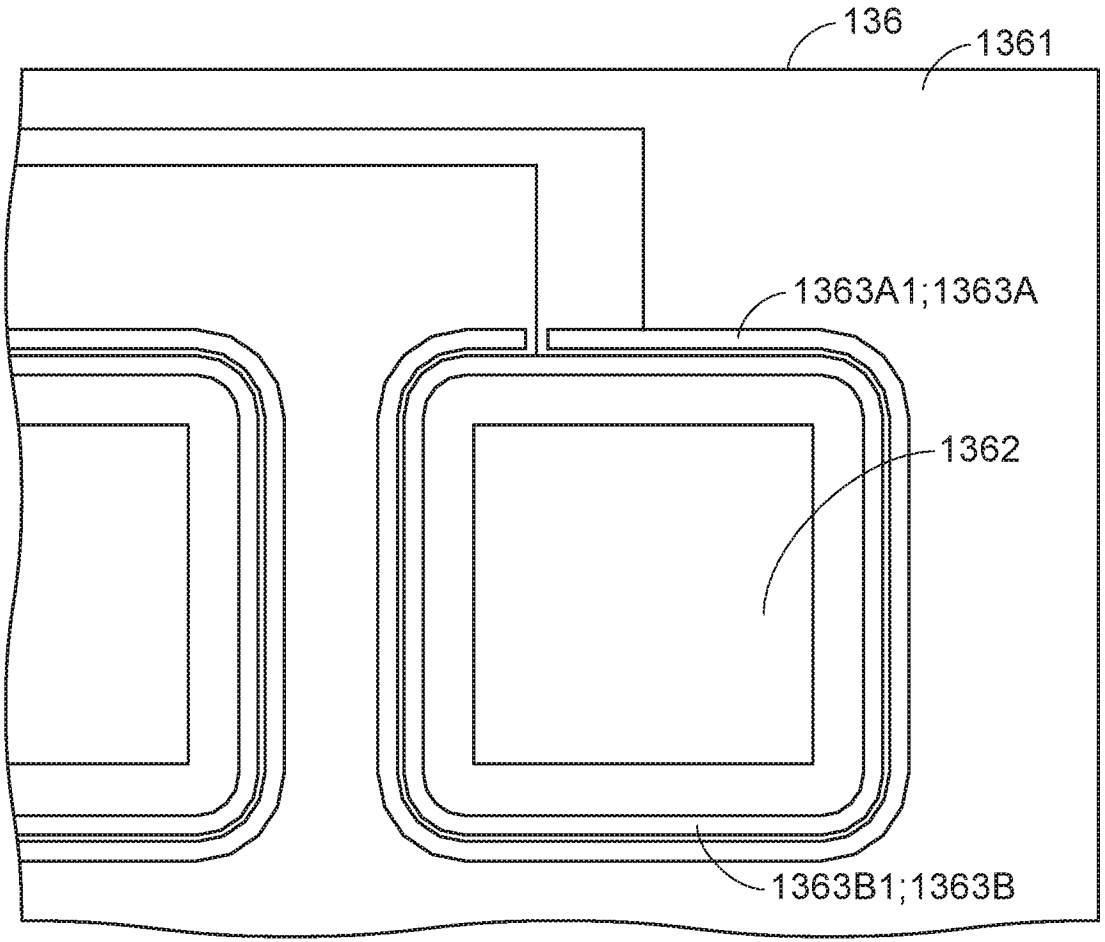
FIG. 4A schematically illustrates a first exemplary circuit structure of the circuit board in the key structure as shown in FIG. 3, in which the circuit patterns of the circuit board have inner and outer ring-shaped configurations.
Figure 4B:
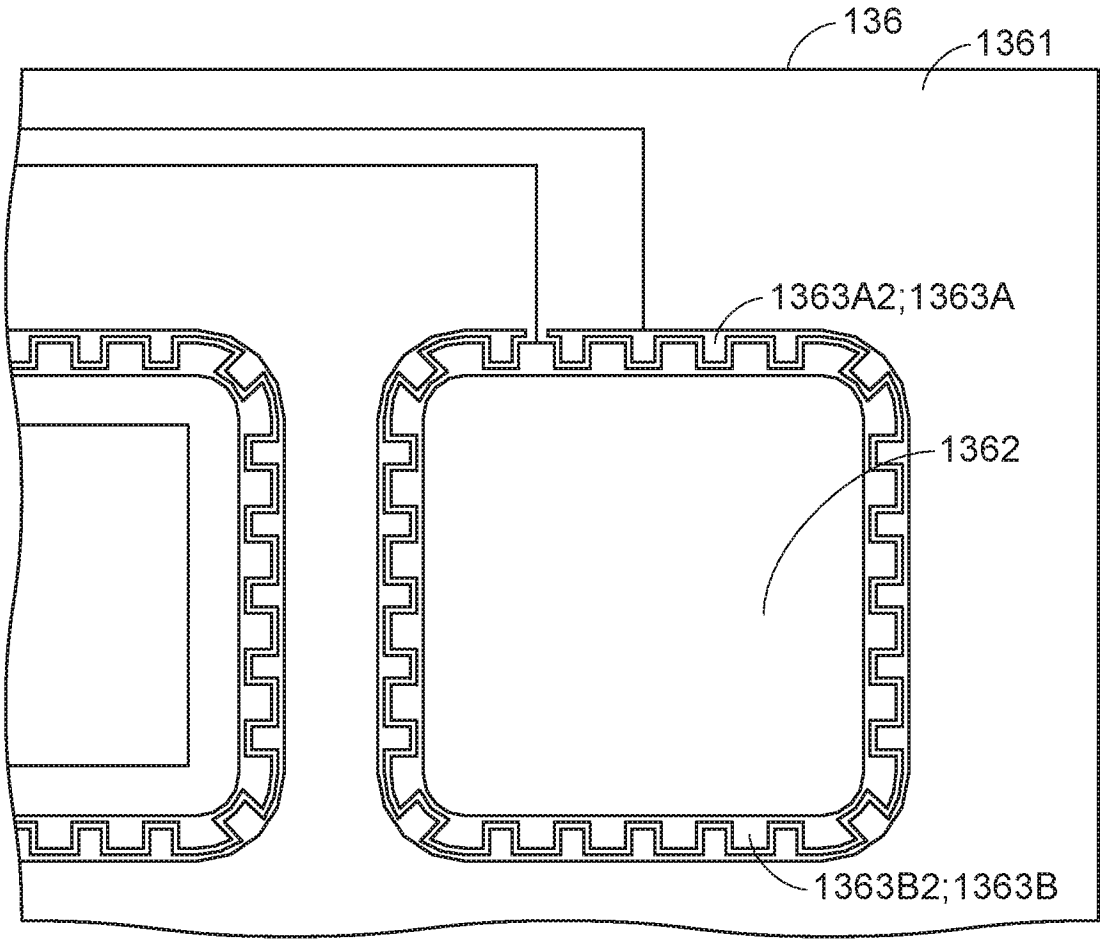
FIG. 4B schematically illustrates a second exemplary circuit structure of the circuit board in the key structure as shown in FIG. 3, in which the circuit patterns of the circuit board have inner and outer concave-convex staggered configurations.
Figure 4C:
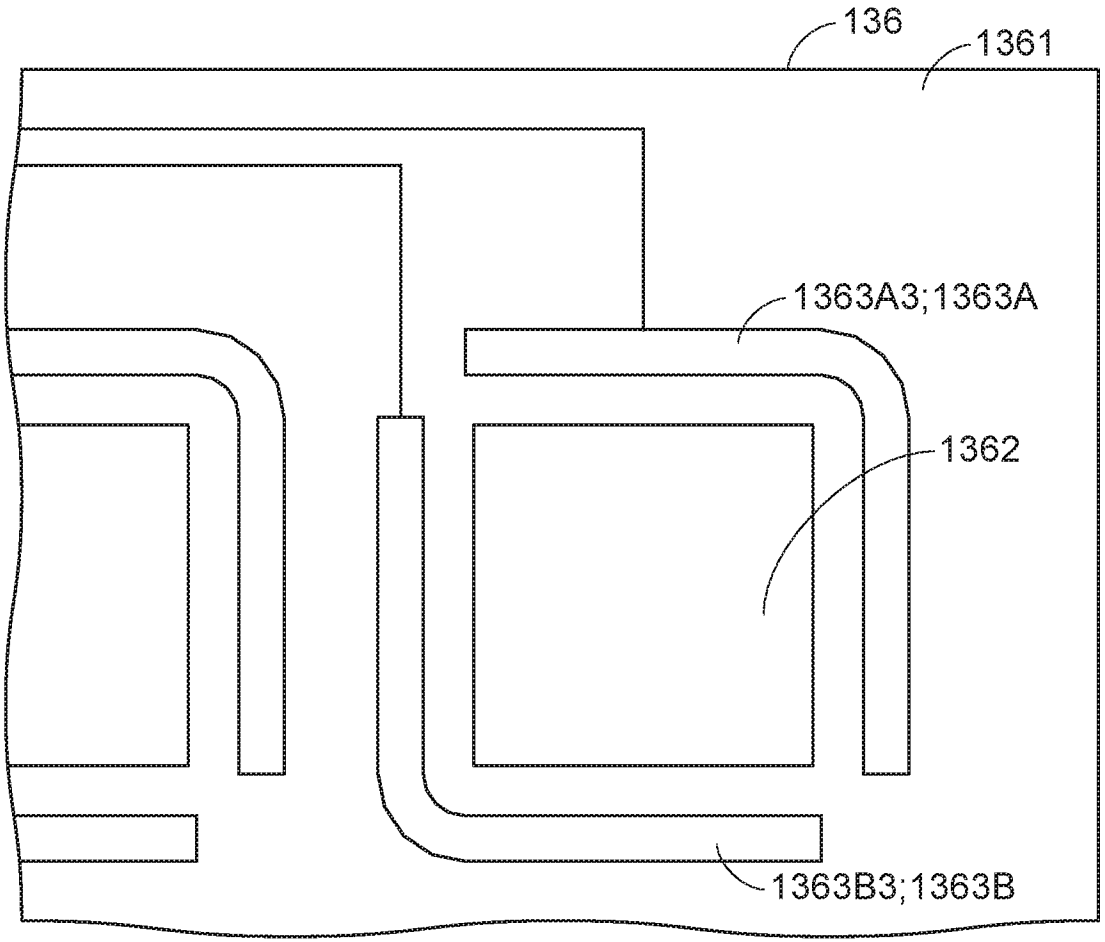
FIG. 4C schematically illustrates a third exemplary circuit structure of the circuit board in the key structure as shown in FIG. 3, in which the circuit patterns of the circuit board have L-shaped configurations.
Figure 5:
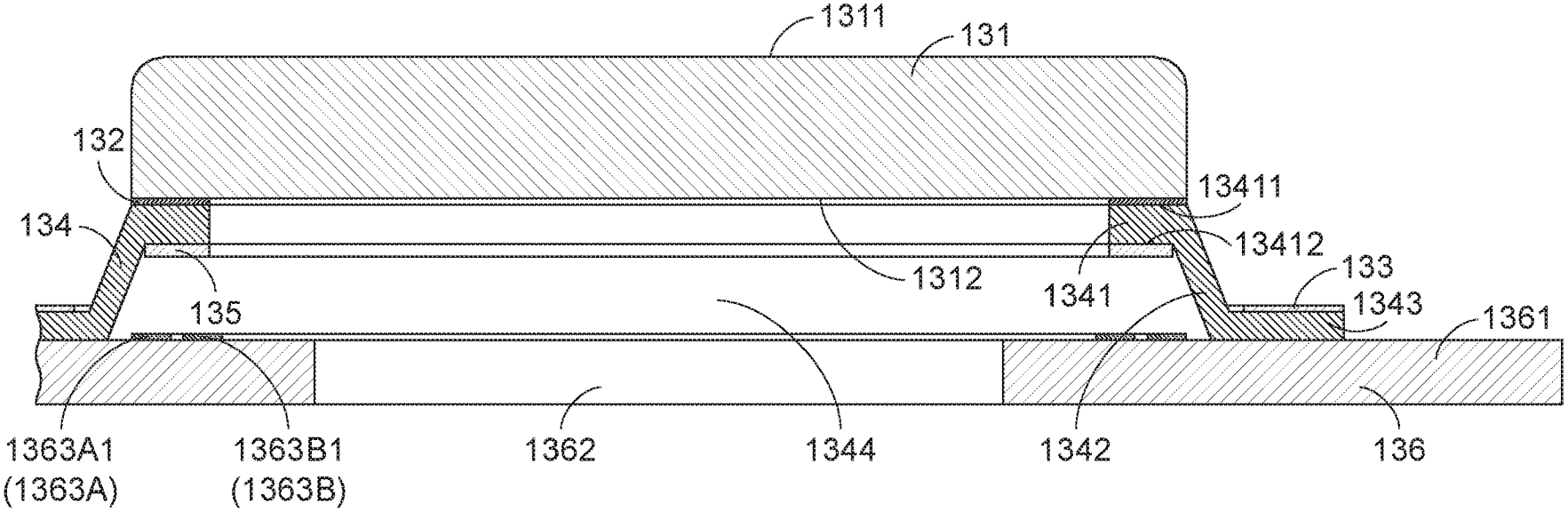
FIG. 5 is a schematic cross-sectional view illustrating a key structure as shown in FIG. 2, in which the key structure is not pressed.
Figure 6:
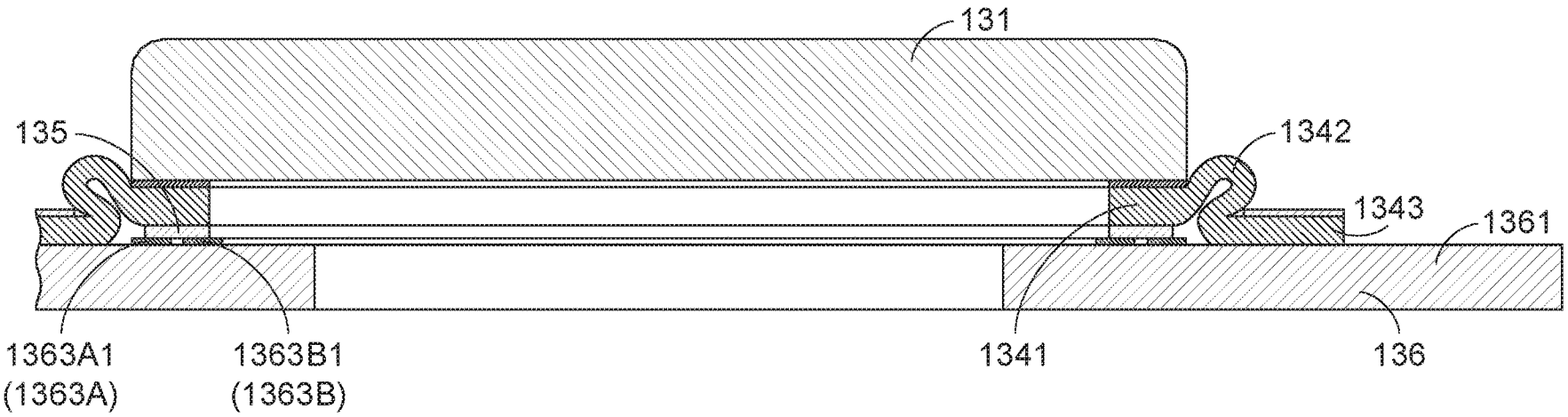
FIG. 6 is a schematic cross-sectional view illustrating a key structure as shown in FIG. 2, in which the key structure is pressed down.

FIG. 1 is a schematic perspective view illustrating a control device according to a first embodiment of the present invention. FIG. 2 is a schematic exploded view illustrating the control device as shown in FIG. 1. FIG. 3 is a schematic perspective view illustrating plural key structures of the control device as shown in FIG. 2. FIG. 4A schematically illustrates a first exemplary circuit structure of the circuit board in the key structure as shown in FIG. 3, in which the circuit patterns of the circuit board have inner and outer ring-shaped configurations. FIG. 4B schematically illustrates a second exemplary circuit structure of the circuit board in the key structure as shown in FIG. 3, in which the circuit patterns of the circuit board have inner and outer concave-convex staggered configurations. FIG. 4C schematically illustrates a third exemplary circuit structure of the circuit board in the key structure as shown in FIG. 3, in which the circuit patterns of the circuit board have inner and outer L-shaped configurations. FIG. 5 is a schematic cross-sectional view illustrating a key structure as shown in FIG. 2, in which the key structure is not pressed. FIG. 6 is a schematic cross-sectional view illustrating a key structure as shown in FIG. 2, in which the key structure is pressed down.

As shown in FIGS. 1 to 6, the control device 1 comprises a covering member 11, an upper cover 12, plural key structures 13, a supporting element 14, a display panel 15 and an outer casing 16.

An accommodation space is defined by the covering member 11 and the outer casing 16 collaboratively. The upper cover 12, the plural key structures 13, the supporting element 14 and the display panel 15 are disposed within the accommodation space. Optionally, a processor, a signal processing device and a communication interface that support the key structures 13 and the display panel 15 are disposed within the control device 1.

According to the predetermined control and setting of the user or the system, different images, information or pictures generated by the display panel 15 can be shown on individual key regions of the key structures 13. Consequently, after a specified key structure 13 is selected and pressed down by the user, the control device 1 issues or executes a control signal corresponding to the image, the information or the picture. Moreover, the image, the information or the picture generated by the display panel 15 can be changed by the user.

In an embodiment, different images, information or pictures generated by the display panel 15 can be combined together in one or plural groups and shown on the plural key regions of the key structures 13. Consequently, a larger image, information or picture can be collaboratively shown on the display panel 15 under the plural key structures 13.

The number of the key structures 13 of the control device 1 may be determined according to the practical requirements or specifications.

As shown in FIG. 2, the covering member 11 comprises plural perforations 111. The positions of the perforations 111 are aligned with the positions of the plural key structures 13. In addition, the sizes of the perforations 111 match the sizes of the corresponding key structures 13. Consequently, portions of the key structures 13 can be exposed outside the corresponding perforations 111 in order to be pressed or operated by the user. Similarly, as shown in FIG. 2, the upper cover 12 comprises plural perforations 121. The positions of the perforations 121 are aligned with the positions of the plural key structures 13. In addition, the sizes of the perforations 121 match the sizes of the corresponding key structures 13. Consequently, portions of the key structures 13 can be exposed outside the corresponding perforations 121 in order to be pressed or operated by the user.

Please refer to FIG. 2 again. The key structures 13 are located over the display panel 15. The supporting element 14 is arranged between the key structures 13 and the display panel 15. The supporting element 14 comprises a hollow portion 141. The image, the information or the picture generated by the display panel 15 can be transmitted upwardly through the hollow portion 141.

Please refer to FIG. 3. Each of the plural key structures 13 comprises a keycap 131, an adhesive layer 132, an adhesive layer 133, an elastic element 134, a conducting element 135 and a circuit board 136.

The keycap 13 is made of a light-transmissible material. The keycap 13 comprises a press surface 1311 and a bottom surface 1312.

The elastic element 134 has the elastic property. Due to the elastic property, the elastic element 134 can be returned to its original position. After the elastic element 134 is combined with the keycap 131, the elastic element 134 provides an elastic force for moving upwardly and downwardly the keycap 131 in a reciprocating manner.

In an embodiment, the elastic element 134 comprises a support part 1341, a lateral wall 1342, a lower part 1343 and an opening 1344. The lateral wall 1342 is arranged between the support part 1341 and the lower part 1343. The support part 1341 and the lateral wall 1342 are arranged around the opening 1344. The lower part 1343 is contacted with the circuit board 136. The material and operation of the elastic element 134 are similar to the rubber dome of the conventional keyboard device. However, a middle region of the elastic element 134 comprises the opening 1344.

The support part 1341 of the elastic element 134 comprises a top surface 13411 and a bottom surface 13412. The top surface 13411 of the support part 1341 is upwardly connected with the bottom surface 1312 of the keycap 131 through the adhesive layer 132. The adhesive layer 132 comprises an opening 1321. The profile of the adhesive layer 132 matches the profile of the top surface 13411 of the support part 1341 of the elastic element 134.

The conducting element 135 has an annular structure with a central hollow portion. The conducting element 135 is disposed on a bottom edge of the support part 1341 of the elastic element 134. That is, the conducting element 135 is disposed on the bottom surface 13412 of the support part 1341. The conducting element 135 is a metal sheet, a conductive rubber sheet, a carbon film, a conductive glue or a conductive foam. Moreover, the conducting element 135 can be formed on the bottom surface 13412 of the support part 1341 by a carbon printing process, a spraying process, a coating process or an injection process.

The lower part 1343 of the elastic element 134 is upwardly attached on the upper cover 12 through the adhesive layer 133. Moreover, the lower part 1343 of the elastic element 134 is downwardly contacted with the circuit board 136.

The lateral wall 1342 of the elastic element 134 has the elastic property. The lateral wall 1342 of the elastic element 134 is bendable or compressible. Consequently, the elastic element 134 can be subjected to deformation and returned to its original position.

The circuit board 136 is located over the display panel 15. The circuit board 136 comprises a top surface 1361, an opening 1362 and a circuit structure 1363. The circuit structure 1363 is installed on the top surface 1361 of the circuit board 136. Moreover, the circuit structure 1363 is arranged around the opening 1362. The circuit structure 1363 at least comprises a first circuit pattern 1363A and a second circuit pattern 1363B. The first circuit pattern 1363A and the second circuit pattern 1363B are separated from each other by a gap. After the light beam generated by the display panel 15 is sequentially transmitted through the opening 1362 of the circuit board 136, the opening 1344 of the elastic element 134 and the light-transmissible keycap 131, the corresponding image, information or picture is visible by the user for facilitating the user's selection or operation.

The arrangements and the profiles of the first circuit pattern 1363A and the second circuit pattern 1363B may be determined according to the application requirements and the use conditions. For example, three examples of the circuit structure are shown in FIGS. 4A, 4B and 4C. As shown in FIG. 4A, the circuit patterns 1363A1 and 1363B1 have inner and outer ring-shaped configurations. For example, the first circuit pattern 1363A is arranged around the second circuit pattern 1363B. As shown in FIG. 4B, the circuit patterns 1363A2 and 1363B2 have inner and outer concave-convex staggered configurations. As shown in FIG. 4C, the circuit patterns 1363A3 and 1363B3 have L-shaped configurations. The arrangements and the profiles of the first circuit pattern 1363A and the second circuit pattern 1363B are not restricted as long as they are separated and not electrically with each other. In FIGS. 3, 5 and 6, the circuit patterns 1363A1 and 1363B1 in ring-shaped configurations are taken as an example. Moreover, the first circuit pattern 1363A and the second circuit pattern 1363B are extended along the circuit board 136 and collected to a connector or other signal processing component.

Please refer to FIGS. 5 and 6. When the keycap 131 is pressed down by the user, the keycap 131 is moved downwardly to push the support part 1341 of the elastic element 134. After the support part 1341 is moved downwardly for a specified travel distance, the conducting element 135 on the bottom edge of the support part 1341 is contacted with the first circuit pattern 1363A1 and the second circuit pattern 1363B1 of the circuit board 136 (see FIG. 6). Consequently, the first circuit pattern 1363A1 and the second circuit pattern 1363B1 are electrically connected with each other. Under this circumstance, the circuit board 136 generates a pressing signal corresponding to the pressed keycap 131.

When the keycap 131 is no longer pressed by the user, the keycap 131 is returned to its original position as shown in FIG. 5 in response to the upward restoring elastic force of the elastic element 134. Meanwhile, the electric connection between the first circuit pattern 1363A1 and the second circuit pattern 1363B1 through the conducting element 135 is interrupted. That is, the first circuit pattern 1363A1 and the second circuit pattern 1363B1 are not electrically connected with each other.

It is noted that numerous modifications may be made while retaining the teachings of the present invention. For example, in some variant examples, the support part 1341 of the elastic element 134 is made of a conductive material, or a conductive material (e.g., particulate metallic material) is doped or added into the support part 1341. Consequently, the support part 1341 has the conducting function. That is, the support part 1341 is electrically conductive. In these variant examples, it is not necessary to install the conducting element 135 on the bottom edge of the support part 1341.

When the keycap 131 is pressed down by the user, the keycap 131 is moved downwardly to push the support part 1341 of the elastic element 134. After the support part 1341 is moved downwardly for a specified travel distance, the support part 1341 is directly contacted with the first circuit pattern 1363A and the second circuit pattern 1363B of the circuit board 136. Consequently, the first circuit pattern 1363A and the second circuit pattern 1363B are electrically connected with each other. Under this circumstance, the circuit board 136 generates a pressing signal corresponding to the pressed keycap 131.

When the keycap 131 is no longer pressed by the user, the keycap 131 is returned to its original position in response to the upward restoring elastic force of the elastic element 134. Meanwhile, the electric connection between the first circuit pattern 1363A and the second circuit pattern 1363B through the conducting element 135 is interrupted. That is, the first circuit pattern 1363A and the second circuit pattern 1363B are not electrically connected with each other.

In the above embodiments of the key structure, the conducting element 135 or the support part 1341 is contacted with and electrically connected with the first circuit pattern 1363A and the second circuit pattern 1363B of the circuit board 136 after the keycap 131 is pressed down. In some other embodiments, the triggering method of the key structure is distinguished. That is, when the keycap is not pressed down, the conducting element or the support part is contacted with and electrically connected with the first circuit pattern and the second circuit pattern of the circuit board. Meanwhile, the key structure or the control device using the key structure does not issue the pressing signal. After the keycap is pressed down, the conducting element or the support part is detached from the first circuit pattern and the second circuit pattern of the circuit board. After a signal processing process is performed, the key structure or the control device using the key structure issues the pressing signal.

A second embodiment of the present invention provides a key structure and a control device using the key structure. In comparison with the first embodiment, the triggering method of the key structure in the second embodiment is distinguished. The other components of the control device of this embodiment are similar to those of the first embodiment, and not redundantly described herein.

Figure 7:
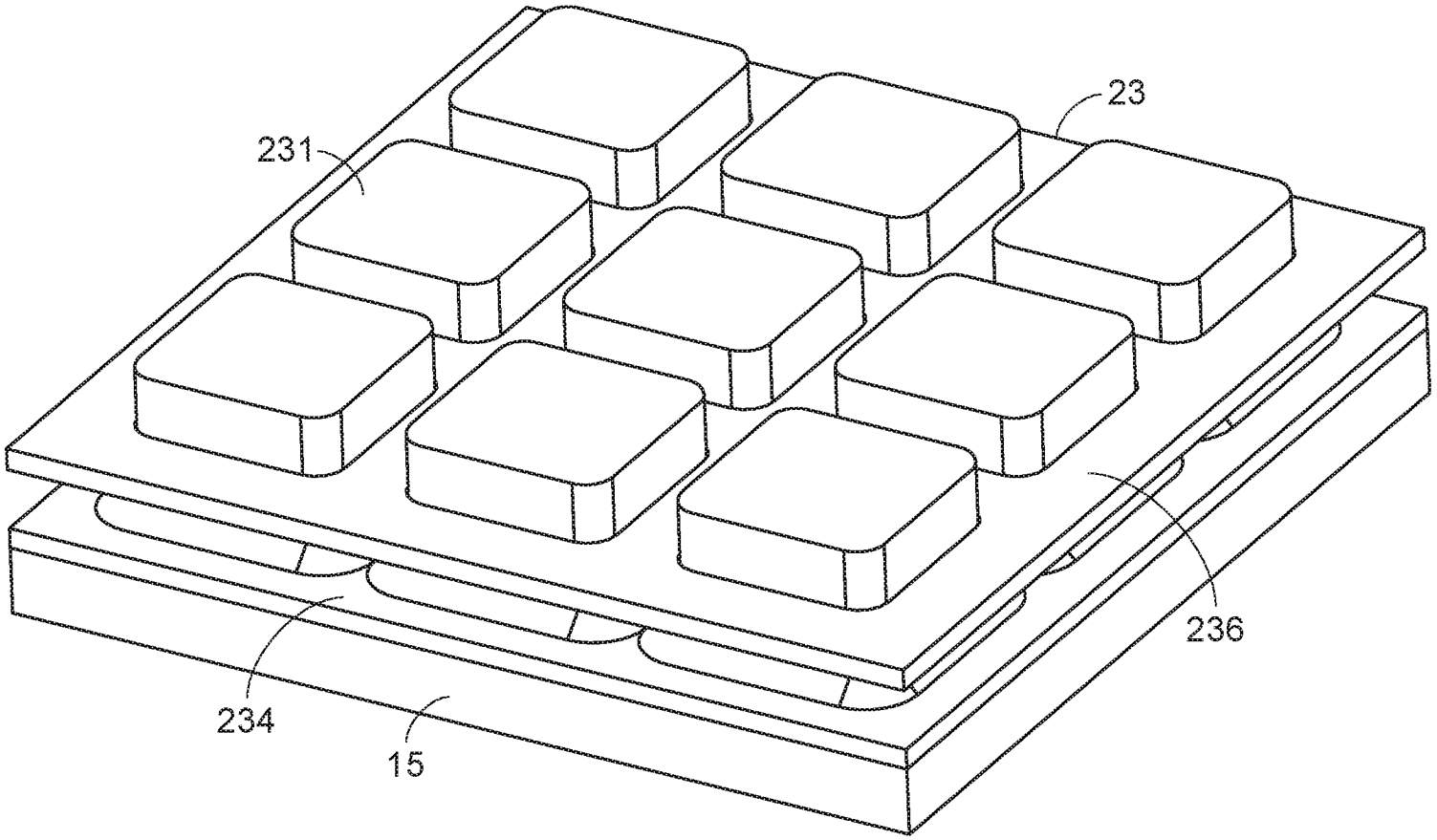
FIG. 7 is a schematic perspective view illustrating plural key structures of a control device according to a second embodiment of the present invention.
Figure 8:
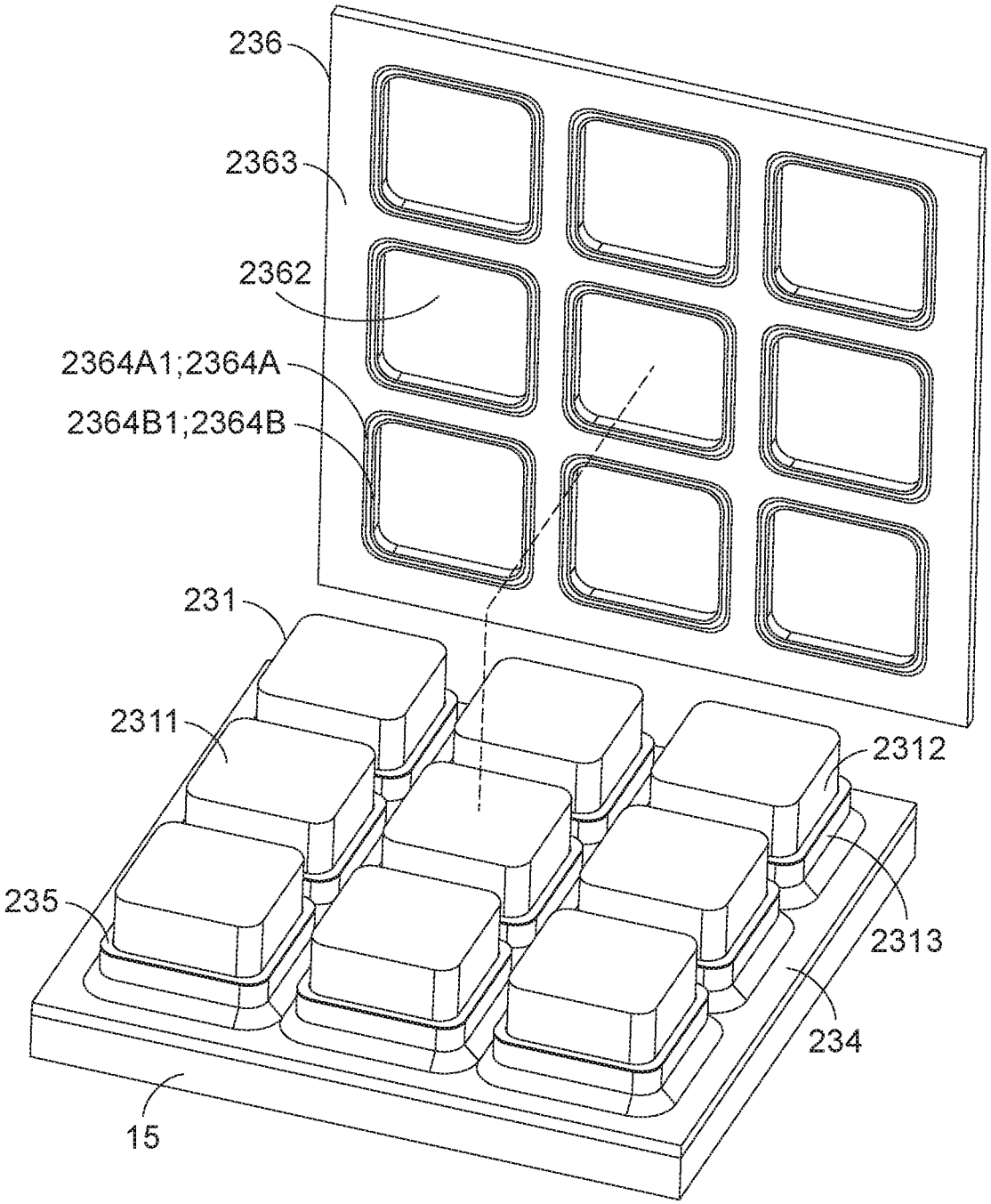
FIG. 8 is a schematic exploded view illustrating portions of the key structures as shown in FIG. 7.
Figure 9:
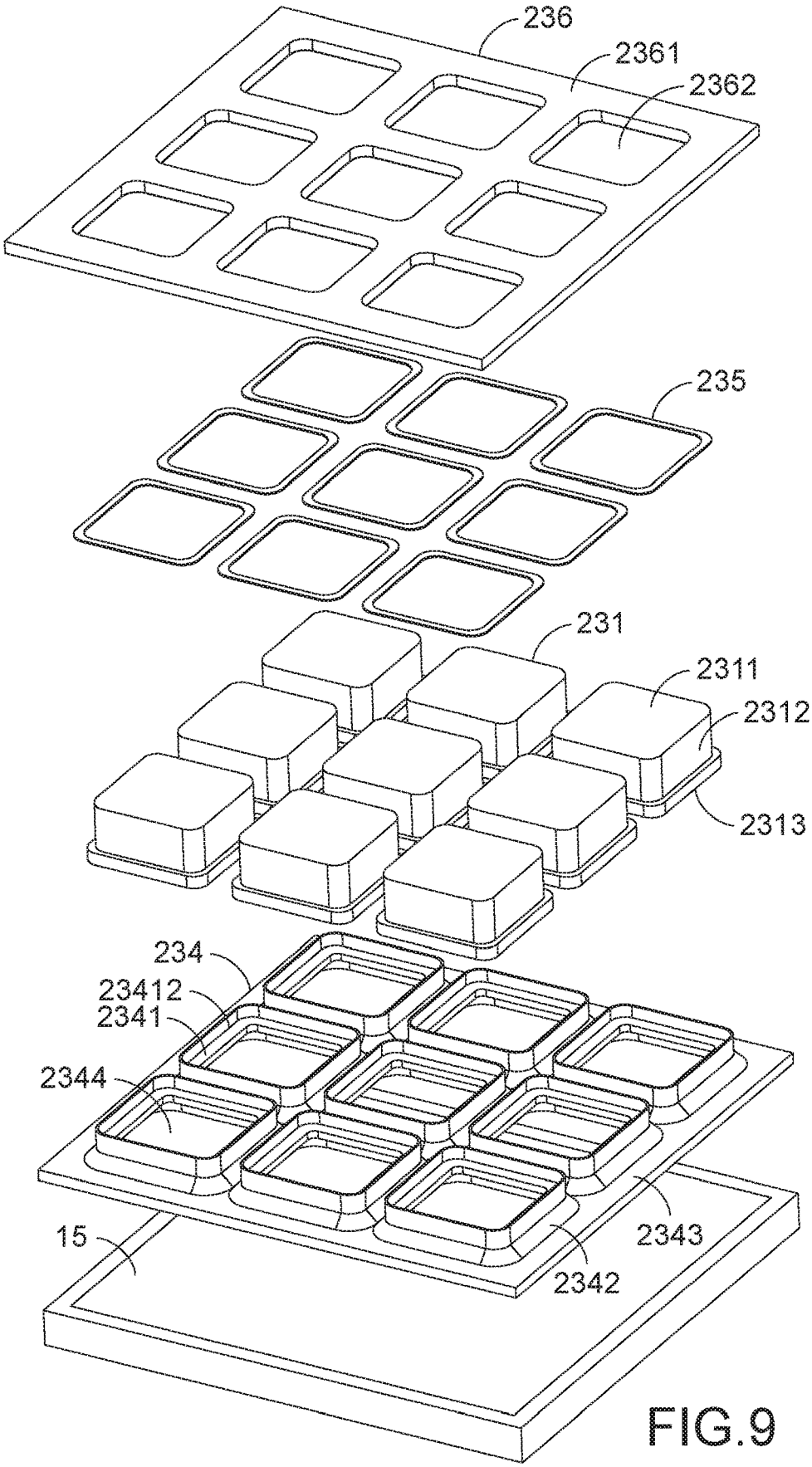
FIG. 9 is a schematic exploded view illustrating the key structures as shown in FIG. 7.
Figure 10:
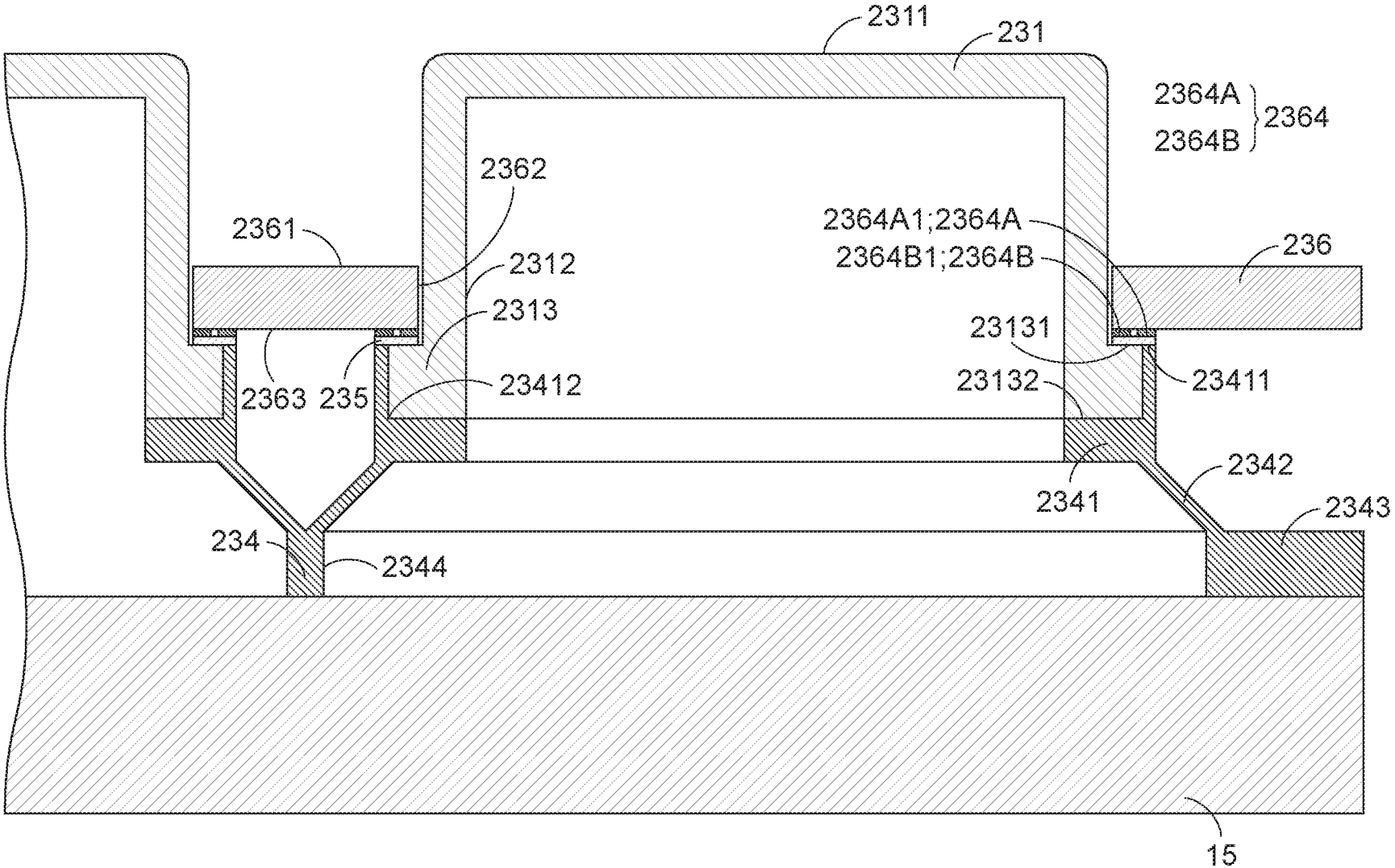
FIG. 10 is a schematic cross-sectional view illustrating the key structure as shown in FIG. 7, in which the key structure is not pressed.
Figure 11:
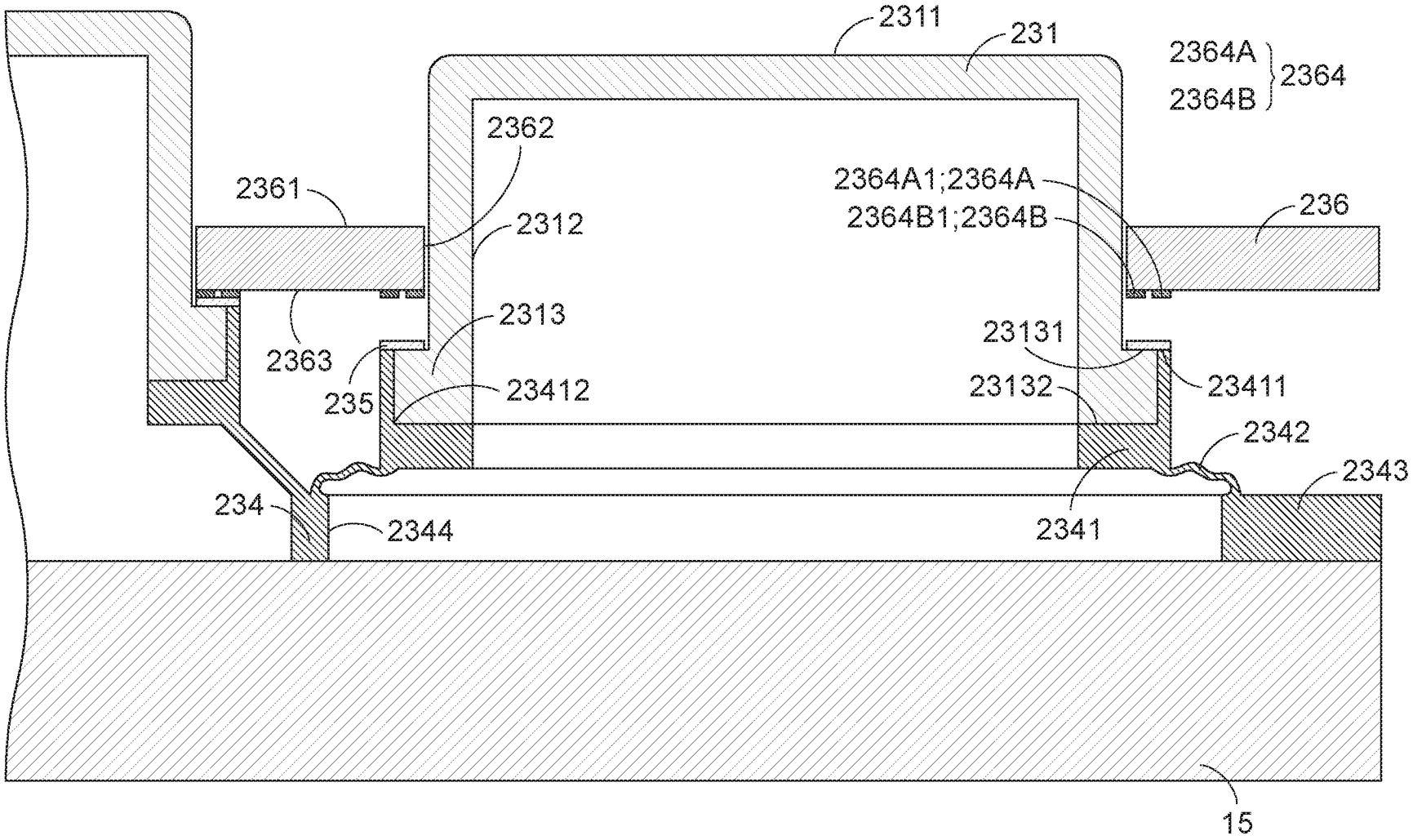
FIG. 11 is a schematic cross-sectional view illustrating the key structure as shown in FIG. 7, in which the key structure is pressed down.

FIG. 7 is a schematic perspective view illustrating plural key structures of a control device according to a second embodiment of the present invention. FIG. 8 is a schematic exploded view illustrating portions of the key structures as shown in FIG. 7. FIG. 9 is a schematic exploded view illustrating the key structures as shown in FIG. 7. FIG. 10 is a schematic cross-sectional view illustrating the key structure as shown in FIG. 7, in which the key structure is not pressed. FIG. 11 is a schematic cross-sectional view illustrating the key structure as shown in FIG. 7, in which the key structure is pressed down.

In FIGS. 7 to 11, the key structures 23 are shown. Each key structure 23 is located over a display panel 15.

Each of the plural key structures 23 at least comprises a keycap 231, an elastic element 234, a conducting element 235 and a circuit board 236.

The keycap 231 is made of a light-transmissible material. The keycap 231 comprises a press surface 2311, a wall part 2312 and a pedestal 2313.

The image, the information or the picture generated by the display panel 15 is transmitted upwardly through the keycap 231 and thus visible by the user. Moreover, the image, the information or the picture defined by the light beams from the display panel 15 can be changed by the user.

The pedestal 2313 is horizontally and externally protruded from the wall part 2312. Moreover, the pedestal 2313 has a top surface 23131 and a bottom surface 23132.

The elastic element 234 has the elastic property. Due to the elastic property, the elastic element 234 can be returned to its original position. After the elastic element 234 is combined with the pedestal 2313 of the keycap 231, the elastic element 234 provides an elastic force for moving upwardly and downwardly the keycap 231 in a reciprocating manner.

In an embodiment, the elastic element 234 comprises a support part 2341, a lateral wall 2342, a lower part 2343 and an opening 2344. The lateral wall 2342 is arranged between the support part 2341 and the lower part 2343. The lateral wall 2342 of the elastic element 234 has the elastic property. The lateral wall 2342 of the elastic element 234 is bendable or compressible. Consequently, the elastic element 234 can be subjected to deformation and returned to its original position. The support part 2341 and the lateral wall 2342 are arranged around the opening 2344. Moreover, the lower part 2343 of the elastic element 234 is downwardly contacted with the display panel 15, or the lower part 2343 of the elastic element 234 is contacted with a supporting element (not shown) between the elastic element 234 and the display panel 15.

The support part 2341 of the elastic element 234 comprises a top surface 23411 and a fixing recess 23412. The fixing recess 23412 has a concave structure. The size of the fixing recess 23412 matches the outer periphery of the pedestal 2313 of the keycap 231. Consequently, the pedestal 2313 of the keycap 231 can be received within the fixing recess 23412. Optionally, the bottom surface 23132 of the pedestal 2313 of the keycap 231 is attached on the inner surface of the fixing recess 23412 by an adhesive layer or any other appropriate fixing means.

The conducting element 235 has an annular structure with a central hollow portion. The conducting element 235 is sheathed around or arranged around the pedestal 2313 of the keycap 231. Moreover, the conducting element 235 is attached on the top surface 23131 of the pedestal 2313 of the keycap 231 and/or the top surface 23411 of the support part 2341 of the elastic element 234. As shown in FIGS. 10 and 11, the conducting element 235 is attached on the top surface 23131 of the pedestal 2313 of the keycap 231 and attached on the top surface 23411 of the support part 2341 of the elastic element 234. It is noted that the position of the conducting element 235 is not restricted. The conducting element 235 is a metal sheet, a conductive rubber sheet, a carbon film, a conductive glue or a conductive foam. Moreover, the conducting element 235 can be formed on the pedestal 2313 or the support part 2341 by a carbon printing process, a spraying process, a coating process or an injection process.

The circuit board 236 is located over the elastic element 234. The circuit board 236 comprises a top surface 2361, an opening 2362, a bottom surface 2363 and a circuit structure 2364. The circuit structure 2364 is installed on the bottom surface 2363 of the circuit board 236. Moreover, the circuit structure 2364 is arranged around the opening 2362. The circuit structure 2364 at least comprises a first circuit pattern 2364A and a second circuit pattern 2364B. The first circuit pattern 2364A and the second circuit pattern 2364B are separated from each other by a gap. The arrangements and the profiles of the first circuit pattern 2364A and the second circuit pattern 2364B may be determined according to the application requirements and the use conditions. The profiles of the circuit patterns are similar to those of the first embodiment. For example, the first circuit pattern 2364A and the second circuit pattern 2364B have ring-shaped profiles, concave-convex staggered profiles or L-shaped profiles. In FIGS. 8, 10 and 11, the circuit patterns 2364A1 and 2364B1 in ring-shaped configurations are taken as an example. Moreover, the circuit pattern 2364A1 is arranged around the circuit pattern 2364B1.

After the light beam generated by the display panel 15 is transmitted through the opening 2344 of the elastic element 234, the opening 2362 of the circuit board 236 and the light-transmissible keycap 231 sequentially, the corresponding image, information or picture is visible by the user for facilitating the user's selection or operation.

Please refer to FIGS. 10 and 11. When the keycap 231 is not pressed down by the user, the conducting element 235 is upwardly contacted with the first circuit pattern 2364A1 and the second circuit pattern 2364B1 on the bottom surface 2363 of the circuit board 236. Under this circumstance, the first circuit pattern 2364A1 and the second circuit pattern 2364B1 are conducted or electrically connected with each other. Meanwhile, the key structure 23 or the control device using the key structure 23 does not issue a pressing signal after a signal processing process is performed.

When the keycap 231 is pressed down by the user, the conducting element 235 is moved downwardly. Consequently, as shown in FIG. 11, the conducting element 235 is detached from the first circuit pattern 2364A1 and the second circuit pattern 2364B1. Under this circumstance, the first circuit pattern 2364A1 and the second circuit pattern 2364B1 are not conducted or electrically connected with each other. After a signal processing process is performed, the key structure 23 or the control device using the key structure 23 issues the pressing signal.

When the keycap 231 is no longer pressed by the user, the keycap 231 is returned to its original position in response to the upward restoring elastic force of the elastic element 234 (see FIG. 10). Meanwhile, the electric connection between the first circuit pattern 2364A1 and the second circuit pattern 2364B1 through the conducting element 235 is established again.

It is noted that numerous modifications may be made while retaining the teachings of the present invention. For example, in some variant examples, the support part 2341 of the elastic element 234 is made of a conductive material, or a conductive material (e.g., particulate metallic material) is doped or added into the support part 2341. Consequently, the support part 2341 has the conducting function. In these variant examples, it is not necessary to install the conducting element 235 on the top surface of the support part 2341.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A control device, comprising:

a display panel; and a key structure located over the display panel, wherein the key structure comprises:

a keycap made of a light-transmissible material, wherein the keycap comprises a press surface, a wall part and a pedestal, wherein the pedestal is horizontally and externally protruded from the wall part, and the pedestal comprises a top surface;

an elastic element comprising a support part, a lateral wall, a lower part and an opening, wherein the support part is connected with the keycap, the lateral wall is arranged between the support part and the lower part, and the support part and the lateral wall are arranged around the opening of the elastic element;

a conducting element disposed on the top surface of the pedestal and the support part; and a circuit board located over the elastic element, and comprising a top surface, a circuit structure, an opening and a bottom surface, wherein the circuit structure is installed on the bottom surface of the circuit board and arranged around the opening of the circuit board, the circuit structure comprises a first circuit pattern and a second circuit pattern, and the first circuit pattern and the second circuit pattern are separated from each other by a gap, wherein when the keycap is not pressed down, the conducting element is contacted with the first circuit pattern and the second circuit pattern, so that the first circuit pattern and the second circuit pattern are electrically connected with each other, wherein when the keycap is pressed down, the conducting element is detached from the first circuit pattern and the second circuit pattern, so that the first circuit pattern and the second circuit pattern are not electrically connected with each other.

2. The control device according to claim 1, wherein the display panel emits a light beam, and the light beam is upwardly transmitted through the opening of the elastic element, the opening of the circuit board and the keycap.

3. The control device according to claim 1, wherein the conducting element is a metal sheet, a conductive rubber sheet, a carbon film, a conductive glue or a conductive foam.

4. The control device according to claim 1, wherein the conducting element is formed on the pedestal or the support part by a carbon printing process, a spraying process, a coating process or an injection process.

5. The control device according to claim 1, wherein each of the first circuit pattern and the second circuit pattern has an L-shaped profile, an annular profile or a concave-convex staggered profile.

6. A control device, comprising:

a display panel; and a key structure located over the display panel, wherein the key structure comprises:

a keycap made of a light-transmissible material, wherein the keycap comprises a press surface, a wall part and a pedestal, wherein the pedestal is horizontally and externally protruded from the wall part, and the pedestal comprises a top surface;

an elastic element comprising a support part, a lateral wall, a lower part and an opening, wherein the support part is connected with the keycap, the lateral wall is arranged between the support part and the lower part, the support part and the lateral wall are arranged around the opening of the elastic element; wherein the pedestal and the support part are electrically conductive; and a circuit board located over the elastic element, and comprising a top surface, a circuit structure, an opening and a bottom surface, wherein the circuit structure is installed on the bottom surface of the circuit board and arranged around the opening of the circuit board, the circuit structure comprises a first circuit pattern and a second circuit pattern, and the first circuit pattern and the second circuit pattern are separated from each other by a gap, wherein when the keycap is not pressed down, the support part is contacted with the first circuit pattern and the second circuit pattern, so that the first circuit pattern and the second circuit pattern are electrically connected with each other, wherein when the keycap is pressed down, the support part is detached from the first circuit pattern and the second circuit pattern, so that the first circuit pattern and the second circuit pattern are not electrically connected with each other.

7. The control device according to claim 6, wherein the display panel emits a light beam, and the light beam is upwardly transmitted through the opening of the elastic element, the opening of the circuit board and the keycap.

8. The control device according to claim 6, wherein the support part is made of a conductive material.

9. The control device according to claim 6, wherein the support part is doped with a conductive material.

10. The control device according to claim 6, wherein each of the first circuit pattern and the second circuit pattern has an L-shaped profile, an annular profile or a concave-convex staggered profile.

* * * * *